US011054781B2

(12) United States Patent
Hiroi

(10) Patent No.: US 11,054,781 B2
(45) Date of Patent: Jul. 6, 2021

(54) IMAGE FORMATION APPARATUS AND MEDIUM CONVEYANCE CONTROL METHOD

(71) Applicant: Oki Data Corporation, Tokyo (JP)

(72) Inventor: Masakazu Hiroi, Tokyo (JP)

(73) Assignee: Oki Electric Industry Co., Ltd., Tokyo (JP)

( * ) Notice: Subject to any disclaimer, the term of this patent is extended or adjusted under 35 U.S.C. 154(b) by 0 days.

(21) Appl. No.: 16/931,445

(22) Filed: Jul. 17, 2020

(65) Prior Publication Data

US 2021/0026281 A1 Jan. 28, 2021

(30) Foreign Application Priority Data

Jul. 24, 2019 (JP) ..... JP2019-136493

(51) Int. Cl.
*G03G 15/00* (2006.01)

(52) U.S. Cl.
CPC ..... *G03G 15/5029* (2013.01)

(58) Field of Classification Search
CPC ..... G03G 15/6567; G03G 2215/00561; G03G 2215/00565; G03G 2215/0016; G03G 2215/00223; G03G 15/164; G03G 15/237; G03G 15/6517; G03G 15/652; G03G 2215/00455; G03G 2215/00405; G03G 2215/0158; G03G 2215/0161; G03G 15/6561
See application file for complete search history.

(56) References Cited

U.S. PATENT DOCUMENTS

2008/0038004 A1* 2/2008 Inoue ..... G03G 15/6564 399/394
2011/0286755 A1* 11/2011 Okano ..... G03G 21/0005 399/34
2014/0064747 A1* 3/2014 Numazu ..... G03G 15/652 399/19
2017/0075276 A1* 3/2017 Fujikura ..... G03G 15/5029
2017/0131671 A1* 5/2017 Nishimura ..... G03G 15/043
2018/0267422 A1* 9/2018 Maeda ..... G03G 15/043

FOREIGN PATENT DOCUMENTS

JP 2017-177364 A 10/2017

* cited by examiner

*Primary Examiner* — Sevan A Aydin
(74) *Attorney, Agent, or Firm* — Metrolex IP Law Group, PLLC

(57) ABSTRACT

An image formation apparatus according to an embodiment may include: an image formation part; a conveyance part that conveys the medium; a detector that detects a leading end of the medium and a position detection mark on the medium; and a conveyance controller that controls the conveyance part under one of a first print mode based on one of the leading end of the medium and the position detection mark and a second print mode based on the other. The conveyance controller is configured, when switching from the first print mode to the second print mode when the medium stands by at a first standby position downstream of the detector, to retract the medium from the first standby position to a position upstream of the detector and then to resume to convey the medium.

11 Claims, 11 Drawing Sheets

| Q MARK SETTING | | FIRST STANDBY POSITION | SECOND STANDBY POSITION |
|---|---|---|---|
| BEFORE CHANGE | AFTER CHANGE | | |
| NO Q MARK DETECTION | BLACK MARK | ○ | ○ |
| | LABEL | ○ | ○ |
| BLACK MARK | NO Q MARK DETECTION | × | × |
| | LABEL | ○ | ○ |
| LABEL | NO Q MARK DETECTION | × | × |
| | BLACK MARK | ○ | ○ |

IMAGE FORMATION APPARATUS AND MEDIUM CONVEYANCE CONTROL METHOD

CROSS REFERENCE TO RELATED APPLICATIONS

This application claims priority based on 35 USC 119 from prior Japanese Patent Application No. 2019-136493 filed on Jul. 24, 2019, entitled "IMAGE FORMATION APPARATUS AND MEDIUM CONVEYANCE CONTROL METHOD", the entire contents of which are incorporated herein by reference.

BACKGROUND

This disclosure may relate to an image formation apparatus and a medium conveyance control method, and for example, may be suitable to be applied to an image formation apparatus that can handle a medium provided with a position detection mark.

In a related art, an image formation apparatus is configured such that when a medium is set (loaded) to the image formation apparatus for image formation (that is, for printing), the image formation apparatus detects a position of a leading end of the medium by a sensor, and performs medium conveyance control based on the detected position of the leading end. To the contrary, there is an image formation apparatus that can handle a medium with position detection marks such as black marks provided at regular intervals in the conveyance direction of the medium. Such an image formation apparatus is configured such that when the medium is set (loaded) to the image formation apparatus, the image formation apparatus detects the position detection marks on the medium, and performs medium conveyance control based on the detected position of the position detection marks (see, for example, Patent Document 1).

Patent Document 1: Japanese Patent Application Publication No. 2017-177364

SUMMARY

However, in a case where the image formation apparatus in the related art includes a print mode to perform the conveyance control based on the detected position of the leading end of the medium and a print mode to perform the conveyance control based on the detected position of the position detection mark on the medium, the image formation apparatus may not be able to appropriately perform the conveyance control sometimes.

An object of an embodiment of the disclosure is to provide an image formation apparatus and a medium conveyance control method that are capable of appropriately performing a medium conveyance control.

An aspect of the disclosure is an image formation apparatus that may include: an image formation part that forms an image on a medium; a conveyance part that conveys the medium; a detector that detects a leading end of the medium and a position detection mark provided on the medium; and a conveyance controller that perform a conveyance control of the medium by controlling the conveyance part under one of a first print mode and a second print mode, wherein the conveyance control of the medium is performed based on one of the leading end of the medium and the position detection mark under the first print mode, and the conveyance control of the medium is performed based on the other of the leading end of the medium and the position detection mark under the second print mode. The conveyance controller is configured, when switching from the first print mode to the second print mode after conveying the medium to and then stopping at a first standby position downstream in a medium conveyance direction of a detection position of the detector under the first print mode, to retract the medium from the first standby position to a position upstream of the detection position of the detector in the medium conveyance direction and then resume to convey the medium in the medium conveyance.

An aspect of the disclosure is a medium conveyance control method executed by an image formation apparatus, wherein the image formation apparatus may include: an image formation part that forms an image on a medium; a conveyance part that conveys the medium; a detector that detects a leading end of the medium and a position detection mark provided on the medium; and a conveyance controller that perform a conveyance control of the medium by controlling the conveyance part. The method may include: conveying the medium under a first print mode that performs the conveyance control with reference to one of the leading end of the medium and the position detection mark to a first standby position downstream of a detection position of the detector in a medium conveyance direction and then stopping the medium at the first standby position; and when switching from the first print mode to a second print mode that performs the conveyance control with reference to the other of the leading end of the medium and the position detection mark after the medium is stopped at the first standby position, retracting the medium from the first standby position to a position upstream in the medium conveyance direction of the detection position of the detector, and then resuming to convey the medium in the medium conveyance direction under the second print mode.

According to at least one of the above aspects, even when the print mode is changed after the medium is set, the position detection mark can be accurately detected and thus the medium can be appropriately conveyed.

As a result, an image formation apparatus and a medium conveying control method that can more reliably perform conveyance control can be realized.

DETAILED DESCRIPTION

Figure 1:
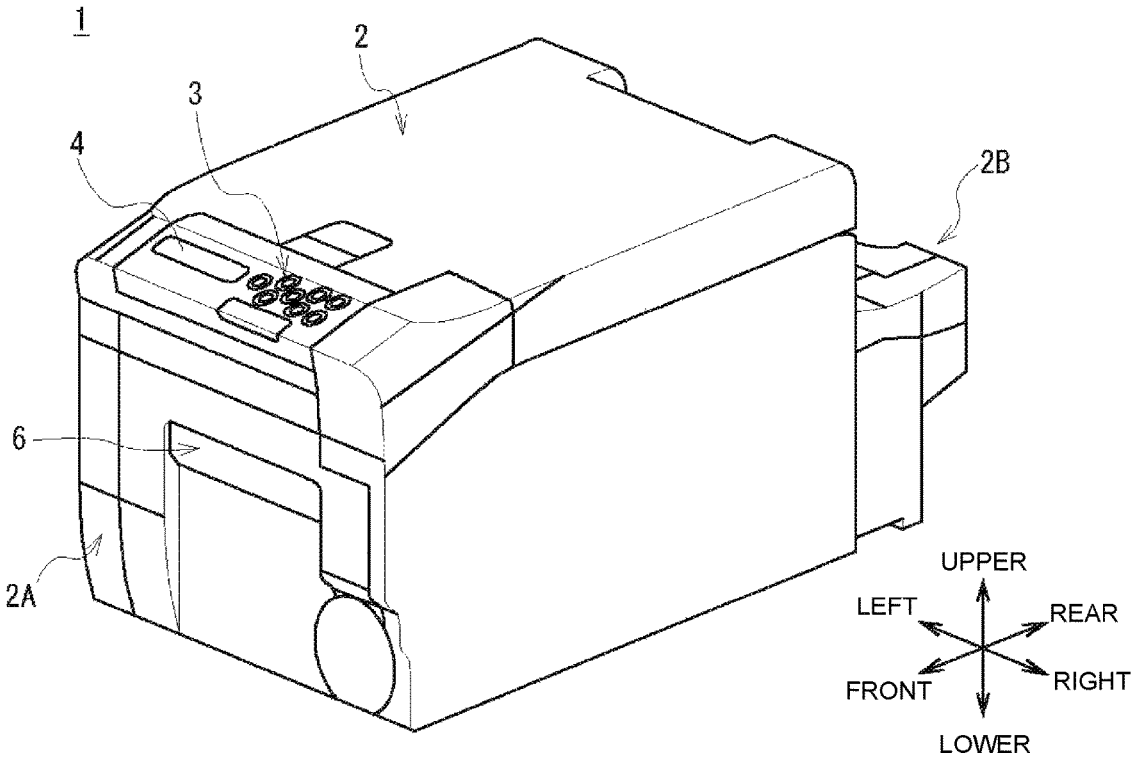
FIG. 1 is a diagram illustrating a perspective view of an external configuration of an image formation apparatus according to a first embodiment.

Descriptions are provided hereinbelow for embodiments based on the drawings. In the respective drawings referenced herein, the same constituents are designated by the same reference numerals and duplicate explanation concerning the same constituents is omitted. All of the drawings are provided to illustrate the respective examples only.

1. First Embodiment

[1-1. External Configuration and Hardware Configuration of Image Formation Apparatus]

Figure 2:
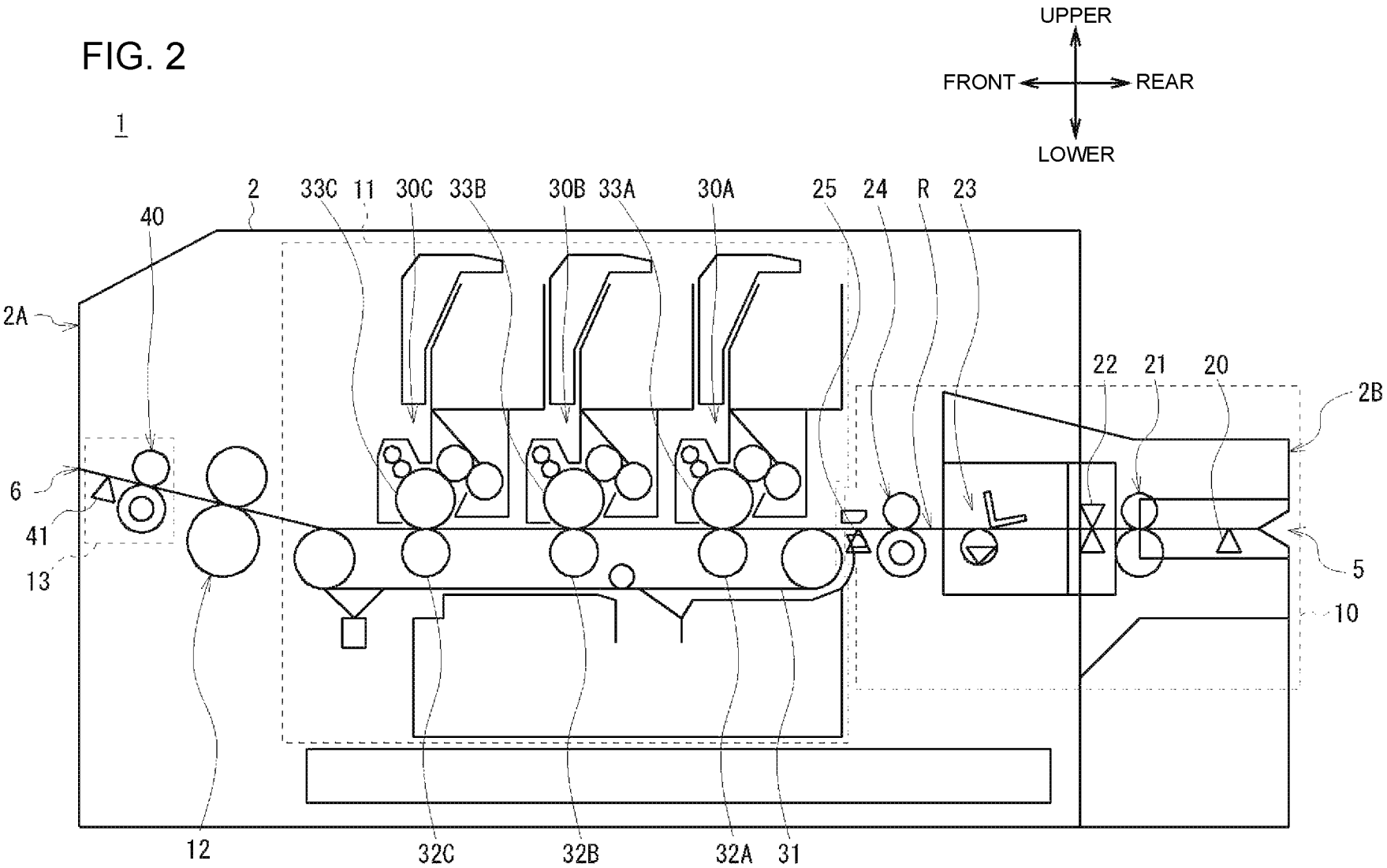
FIG. 2 is a diagram illustrating a side sectional view of a hardware configuration of the image formation apparatus according to a first embodiment.

FIG. 1 illustrates an external configuration of an image formation apparatus 1 according to a first embodiment. FIG. 2 illustrates a hardware configuration in the image formation apparatus 1. Note that FIG. 1 is a diagram illustrating an external perspective view of the image formation apparatus 1 viewed from a front side thereof. FIG. 2 is a diagram illustrating a side cross sectional view of the image formation apparatus 1. As illustrated in FIGS. 1 and 2, the image formation apparatus 1 is an electrophotographic printer to form an image (that is, to perform printing) on a surface of a long sheet such as a long paper serving as a medium while conveying the long sheet.

Figure 3A:
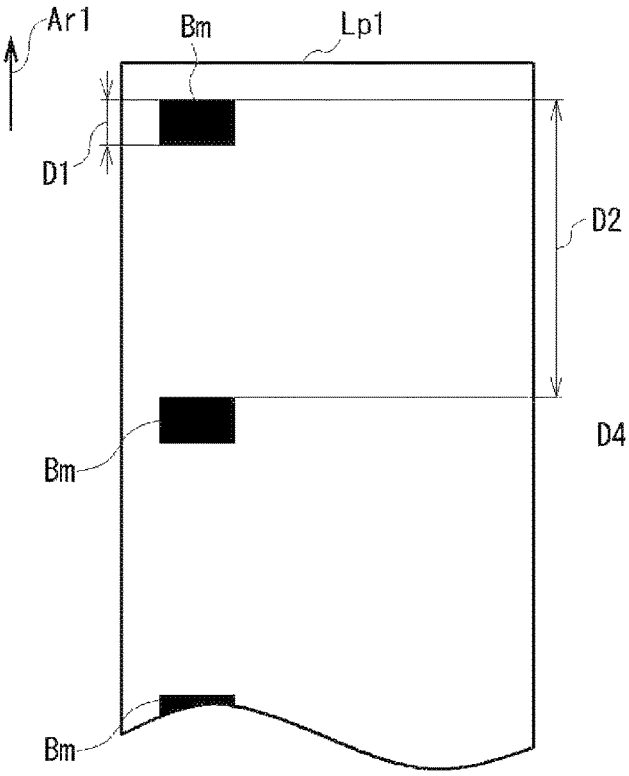
FIGS. 3A and 3B are diagrams illustrating a configuration of a long sheet according to a first embodiment.
Figure 3B:
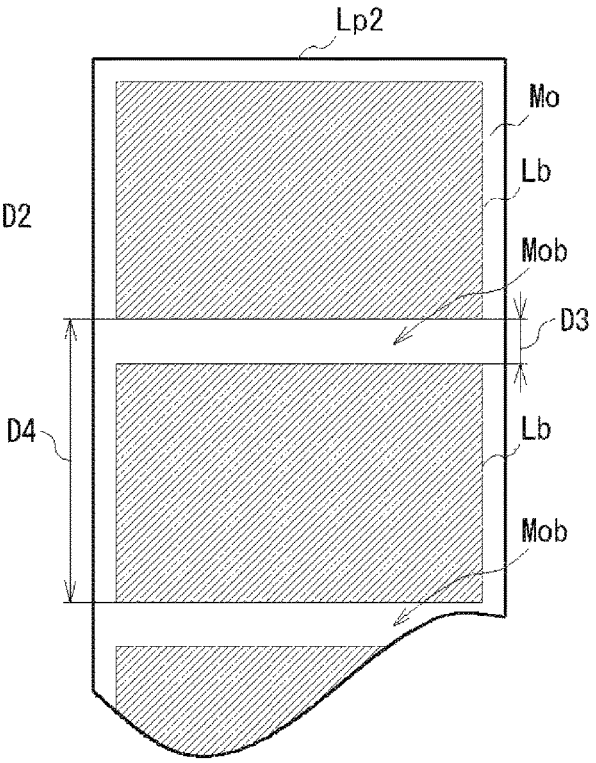

Long sheets that the image formation apparatus 1 can handle may include: a long sheet Lp1 having a front surface on which an image is to be printed and a back surface opposite to the front surface, wherein on the back surface thereof black marks Bm are marked at regular intervals in a sheet conveyance direction indicated by arrow Ar1 as illustrated in FIG. 3A, and a long sheet Lp2 having a front surface on which an image is to be printed, wherein on the front surface of the long sheet Lp2 Labels Lb are attached at regular intervals in the sheet conveyance direction indicated by arrow Ar1 as illustrated in FIG. 3B, for example. The back marks Bm marked on the long sheet Lp1 are position detection marks (hereinafter, may be referred to as Q marks) for detecting the position of the long sheet Lp1 during the conveyance of the long sheet Lp1. The back marks Bm (Q marks) may be used for appropriately setting a cut timing for cutting the long sheet Lp1, an image formation timing for forming an image on the long sheet Lp1, or the like.

To the contrary, the long sheet Lp2 has a structure in which the labels Lb are attached to a mount Mo or a backing sheet. In the long sheet Lp2, a portion Mob of the mount Mo that is provided between adjacent two of the labels Lb in the conveyance direction (hereinafter may be referred to as an inter-label mount portion Mob) is treated as a Q mark. Like the black marks Bm, the inter-label mount portions Mob also serve as marks to be used for appropriately setting the cut timing, the image formation timing, and the like for the long sheet Lp2. The long sheet Lp2 may have the black marks Bm on the back surface thereof at regular intervals. Note that in the following description, the long sheet Lp1 and the long sheet Lp2 may be referred to as the long sheet Lp unless otherwise specified.

As illustrated in FIG. 1, the image formation apparatus 1 has a substantially box-shaped housing 2. Here, a direction from a front surface 2A to a rear surface 2B of the housing 2 is referred to as a rear direction, a direction from the rear surface 2B to the front surface 2A is referred to as a front direction, a direction from a lower side to an upper side of the housing 2 is referred to as an upper direction, a direction from the upper side to the lower side of the housing 2 is referred to as a lower direction, a direction from a right side to a left side of the housing 2 is referred to as a left direction, and a direction from the left side to the right side of the housing 2 is referred to as a right direction.

An operation part 3 and a display 4 are provided on an upper surface of the housing 2 on a side of the front surface 2A thereof. The operation part 3 serving as a user interface includes, for example, buttons or the like, and receives an operation by the user. The display 4 includes, for example, a liquid crystal panel or the like, and displays various information including a state of the image formation apparatus 1 or the like. The rear surface 2B of the housing 2 is provided with an input port 5 (FIG. 2) from which the long sheet Lp is to be inserted. The front surface 2A of the housing 2 is provided with a discharge port 6 from which the long sheet Lp is to be discharged. Although not illustrated in FIGS. 1 and 2, the long sheet Lp is, for example, roll paper wound in a roll shape, and the long sheet Lp is set to the image formation apparatus 1 with a leading end of the long sheet LP is inserted from the input port 5 by the user.

As illustrated in FIG. 2, a conveyance path R for the long sheet Lp is provided in the housing 2. The conveyance path R extends from the input port 5 provided at the rear surface 2B to the discharge port 6 provided at the front surface 2A in the front-rear direction. Along the conveyance path R, components making up the electrophotographic printer are arranged. Note that in this embodiment, the long sheet Lp is conveyed in such a manner the front surface of the long sheet Lp on which an image is to be formed is oriented upward.

Specifically, in the housing 2, the sheet feeder 10 is provided in vicinity of the input port 5, which is provided on an upstream end portion in the sheet conveyance direction of the conveyance path R. In the housing 2, an image formation part 11 is provided on the downstream side in the sheet conveyance direction (or on the front side) of the sheet feeder 10. In the housing, a fixation device 12 is provided on the downstream side of the image formation part 11 in the sheet conveyance direction. In the housing, a sheet discharge part 13 is provided on the downstream side of the fixation device 12 in the sheet conveyance direction.

Figure 4:
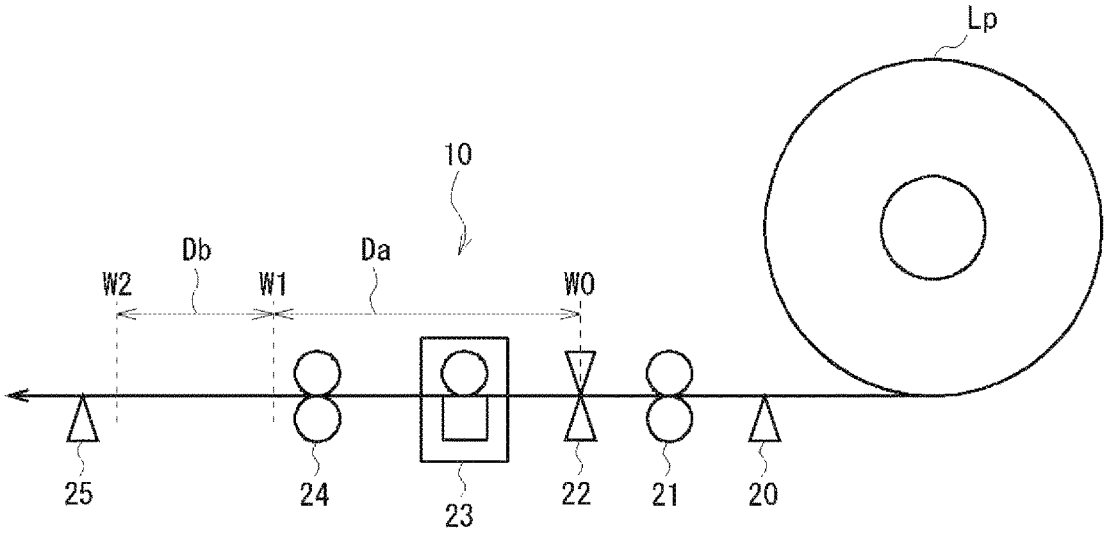
FIG. 4 is a diagram illustrating an enlarged view of a configuration of a sheet feeder according to a first embodiment.

The sheet feeder 10 is configured to convey the long sheet Lp inserted from the input port 5 to the image formation part 11. As illustrated in the simplified enlarged view of FIG. 4 in addition to FIG. 2, the sheet feeder 10 includes: a sheet set detection sensor 20, a first conveyance roller pair 21, a Q mark detection sensor 22, a cutter 23, a second conveyance roller pair 24, and a write sensor 25, in that order from the upstream side to the downstream side in the sheet conveyance direction along the conveyance path R.

The sheet set detection sensor 20 is a sensor configured to detect the presence or absence of the long sheet Lp. Based on the detection result of the sheet set detection sensor 20, when the long sheet Lp is detected, it is determined that the long sheet Lp is set in the image formation apparatus 1.

Each of the first conveyance roller pair 21 and the second conveyance roller pair 24 includes two conveyance rollers opposed to each other in the vertical direction with the conveyance path R therebetween. Each of the first conveyance roller pair 21 and the second conveyance roller pair 24 is configured to convey the long sheet Lp with sandwiching the long sheet Lp by the two conveyance rollers thereof.

The Q mark detection sensor 22 is a sensor configured to detect the presence or absence of the long sheet Lp and detect the Q marks (black marks Bm, inter-label mount portions Mob) provided on the long sheet Lp. The Q mark detection sensor 22 is, for example, a transmissive photoelectric sensor configured to emit light from a lower side of the conveyance path R and receives the light on an upper side of the conveyance path R, for example. Based on the detection result (the amount of received light) of the Q mark detection sensor 22, the Q mark detection sensor 22 can detect that the leading end of the long sheet Lp reaches the detection position W0 of the Q mark detection sensor 22, one end of the Q mark in the sheet conveyance direction reaches the detection position W0 of the Q mark detection sensor 22, the other end of the Q mark in the sheet conveyance direction reaches the detection position W0 of the Q mark detection sensor 22, or the like. Note that hereinafter, the one end and the other end of the Q mark in the sheet conveyance direction may be referred to as a leading end and a tail end of the Q mark, respectively.

The cutter 23 is a device or a part that is configured to cut the long sheet Lp along a widthwise direction or a short-side direction of the long sheet Lp orthogonal to the sheet conveyance direction, for example. The write sensor 25 is a sensor configured to detect the leading end of the long sheet Lp. Based on the detection result of the write sensor 25, the image formation timing (the timing to start writing) onto the long sheet Lp by the image formation part 11 is set.

In the sheet feeder 10, a first standby position W1 is provided at a position W1 in the conveyance path R, which is located between the second conveyance roller pair 24 and the write sensor 25 and in the vicinity of the second conveyance roller pair 24, to make the long sheet Lp1 standing by. Further, in the sheet feeder 10, a second standby position W2 is provided at a position W2 in the conveyance path R, which is located between the second conveyance roller pair 24 and the write sensor 25 and located on the downstream side of the sheet conveyance direction from the first standby position W1. That is, when making the long sheet Lp standing by in the sheet feeder 10, the long sheet Lp stands by with the leading end of the long sheet Lp being located at the first standby position W1 or the second standby position W2. Note that the reason for providing the first and second standby positions W1 and W2 as the standby positions for the long sheet Lp is described later.

The image formation part 11 (FIG. 2), which is located on the downstream side of the sheet feeder 10 in the sheet conveyance direction, is a device or a component configured to form (to print) an image on the long sheet Lp being conveyed from the sheet feeder 10. The image formation part 11 includes plural (for example, three) image formation units 30 (30A to 30C) above the conveyance path R and plural (for example, three) transfer rollers 32 (32A to 32C) and a transfer belt 31 below the conveyance path R.

The three image formation units 30A to 30C are arranged along the conveyance path R in the front-rear direction, and correspond to three color toners used in the image formation apparatus 1, respectively. Each of the image formation units 30 (30A to 30C) forms a toner image of the corresponding color on the corresponding photosensitive drum 33 (33A to 33C), which is to be transferred to the long sheet Lp.

The transfer belt 31 is an endless belt or an annular belt extending in the front-rear direction along the conveyance path R. The transfer belt 31 is configured to run in the front-rear direction to convey the long sheet Lp along the conveyance path R. The three transfer rollers 32A to 32C are provided inside of the transfer belt 31 and opposed to the three photosensitive drums 33A to 33C, respectively, with the transfer belt 31 therebetween. The three transfer rollers 32A to 32C transfer the toner images of the respective colors from the photosensitive drums 33A to 33C onto the long sheet Lp when the long sheet Lp passes between the transfer rollers 32A to 32C and the photosensitive drums 33A to 33C.

The fixation device 12, which is located on the downstream side of the image formation part 11 in the sheet conveyance direction, is a device or a component configured to fix the toner image transferred on the long sheet Lp to the long sheet Lp by heating and pressing the long sheet Lp. The sheet discharge part 13, which is located on the downstream side of the fixation device 12 in the sheet conveyance direction, is a device or a component configured to discharge from the discharge port 6 to the outside of the housing 2 the long sheet Lp that has passed the fixation device 12. The sheet discharge part 13 includes a third conveyance roller pair 40 and a discharge sensor 41 which are provided in vicinity of the discharge port 6 along the conveyance path R. The third conveyance roller pair 40 is configured to include two conveyance rollers opposed to each other in the vertical direction with the conveyance path R therebetween. The third conveyance roller pair 40 is configured to convey the long sheet Lp while sandwiching the long sheet Lp between the two conveyance rollers thereof. The discharge sensor 41 is a sensor to detect the presence or absence of the long sheet Lp. The discharge sensor 41 is provided between the third conveyance roller pair 40 and the discharge port 6. Based on the detection result of the discharge sensor 41, when the long sheet Lp is detect, it is determined that the long sheet Lp has been discharged from the image formation apparatus 1. The external configuration and internal hardware configuration of the image formation apparatus 1 are as described above.

[1-2. Functional Configuration of Image Formation Apparatus]

Figure 5:
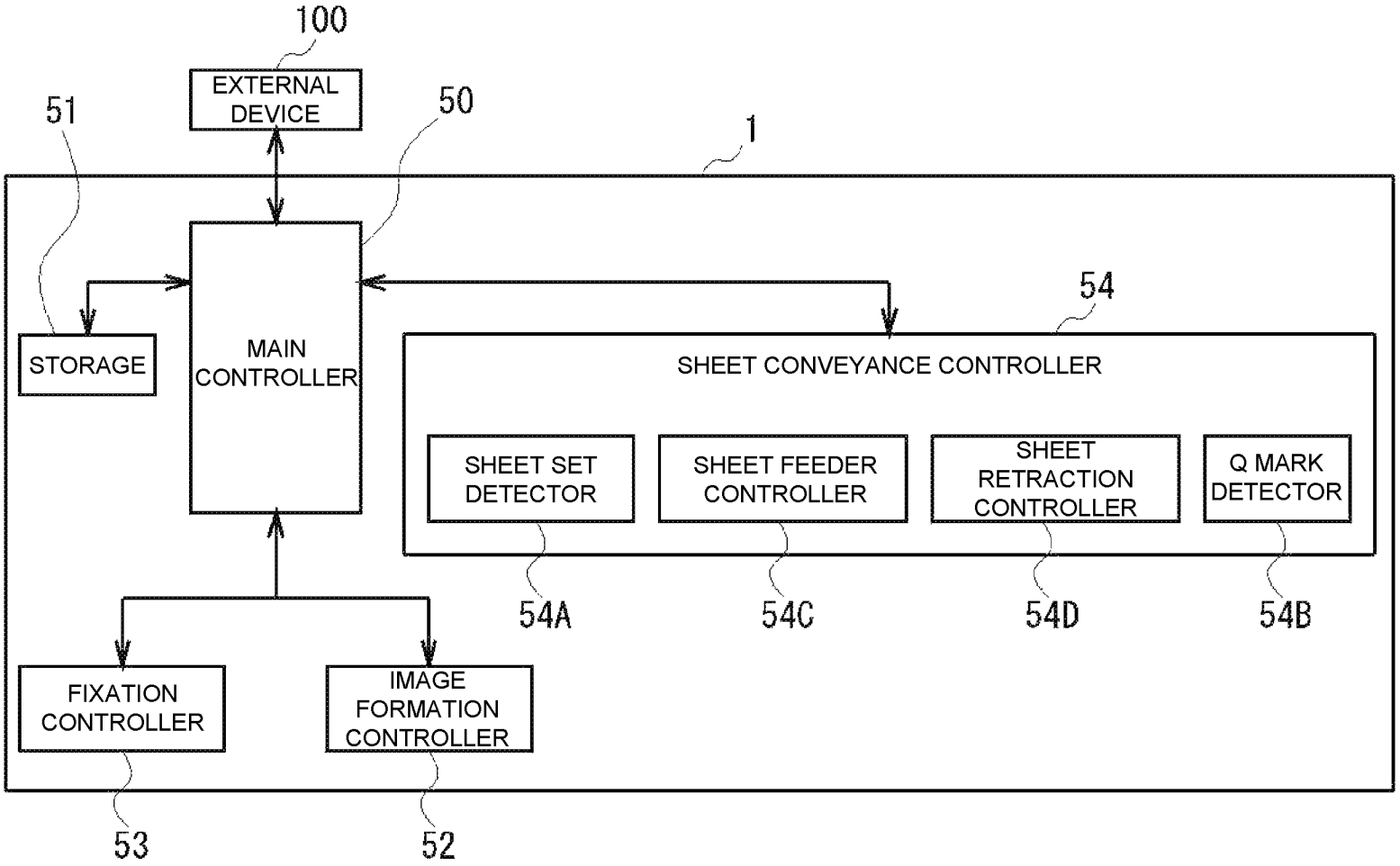
FIG. 5 is a block diagram illustrating a functional configuration of the image formation apparatus according to a first embodiment.

Next, a functional configuration of the image formation apparatus 1 is explained with reference to a block diagram illustrated in FIG. 5. The image formation apparatus 1 has, as a functional configuration, a main controller 50, a storage 51, and an image formation controller 52, a fixation controller 53, and a sheet conveyance controller 54 as a conveyance controller. Note that the controllers 50, 52, 53, 54 and the like may be implemented using: a memory(s) as a storage device(s) that stores a control program(s); and a processor(s) that executes the control program(s) stored in the memory(s). Otherwise, parts of the controllers 50, 52, 53, 54 and the like may be implemented using a circuit(s), and the rests of the controllers 50, 52, 53, 54 and the like may be implemented using: a memory(s) as a storage device(s) that stores a control program(s); and a processor(s) that executes the control program(s) stored in the memory(s).

The main controller 50 controls an entire of the image formation apparatus 1 by reading and executing program(s) stored in the storage 51, and performs printing on the long sheet Lp. Specifically, the main controller 50 receives print setting information and print data sent from a higher-level device 100 or an external device 100 such as a PC (personal computer), and performs various printing settings based on the received print setting information and controls the image formation controller 52, the fixation controller 53, and the sheet conveyance controller 54 to print an image based on the received print data on the long sheet Lp.

The print setting information sent from the external device 100 includes Q mark setting that indicates whether or not to use the Q marks. This Q mark setting is set to "Q mark detection" when the Q marks are to be used for printing, and is set to "No Q mark detection" when the Q mark is not to be used for printing.

When the Q mark setting is set to "No Q mark detection", the main controller 50 controls each components of the image formation apparatus under a first print mode (hereinafter may be referred to as a normal print mode) to perform the conveyance control for the long sheet Lp based on the detected position of the leading end of the long sheet Lp detected by the Q mark detection sensor 22. On the other hand, when the Q mark setting is set to "Q mark detection", the main controller 50 controls each components of the image formation apparatus under a second print mode (hereinafter may be referred to as a Q mark print mode) to perform the conveyance control for the long sheet Lp based on the detected position of the Q marks detected by the Q mark detection sensor 22.

The storage 51 or a memory stores therein program(s), print data, a leading end position of the long sheet Lp, a Q mark position, various print settings, and etc. The image formation controller 52 forms an image on the long sheet Lp by controlling the image formation part 11 according to instructions of the main controller 50. The fixation controller 53 controls according to instructions of the main controller 50 the fixation device 12 so as to fix the image formed on the long sheet Lp to the long sheet Lp.

The sheet conveyance controller 54 controls, according to instructions of the main controller 50, driving of the first to third conveyance roller pairs 21, 24, and 40 and the transfer belt 31 serving as a conveyance part(s) or a conveyance device(s), so as to convey the long sheet Lp along the conveying path R. The sheet conveyance controller 54 includes a sheet set detector 54A, a Q mark detector 54B serving as a detector, a sheet feeder controller 54C, and a sheet retraction controller 54D.

The sheet set detector 54A detects, based on the detection result of the sheet set detection sensor 20, whether or not the long sheet Lp is set to the image formation apparatus 1. The Q mark detector 54B detects, based on the detection result of the Q mark detection sensor 22, the leading end position of the long sheet Lp and the positions of the Q marks. Specifically, the Q mark detector 54B calculates, as the position of the Q mark, a midpoint between the position of the leading end and the position of the tail end of the Q mark detected by the Q mark detection sensor 22.

Based on the leading end position of the long sheet Lp obtained by the Q mark detector 54B, the sheet feeder controller 54C conveys the long sheet Lp set to the image formation apparatus 1 to the first standby position W1 or the second standby position W2 and stops the long sheet Lp there. Specifically, the sheet feeder controller 54C conveys the long sheet Lp to the first standby position W1 and stops the long sheet Lp at the first standby position W1 in the normal print mode, and the sheet feeder controller 54C conveys the long sheet Lp to the second standby position W2 and stops the long sheet Lp at the second standby position in the Q mark print mode.

The sheet retraction controller 54D retracts (pulls back) in the reverse direction the long sheet Lp that was stopped at the first standby position W1 or the second standby position W2 until the Q mark detection sensor 22 detects the leading end of the long sheet Lp, and then stops the retraction of the long sheet Lp. At this time, the long sheet Lp is stopped at the position where the leading end of the long sheet Lp is slightly upstream of the detection position Wo of the Q mark detection sensor 22 in the sheet conveyance direction. That is, the sheet retraction controller 54D pulls the long sheet Lp back to the position where the leading end of the long sheet Lp is upstream in the sheet conveyance direction of the detection position W0, and stops the long sheet Lp at the position. When the sheet retraction controller 54D retracts the long sheet Lp is explained in detail later.

Further, the sheet conveyance controller 54 notifies, when the sheet set detector 54A detects that the long sheet Lp is set, it to the main controller 50. When the main controller 50 receives the notification indicating that the long sheet Lp is set, the main controller 50 instructs, for example, the image forming controller 52 and the fixing controller 53 to start a printing preparation. Further, the sheet conveyance controller 54 also notifies the main controller 50 of the leading end position and the Q mark position of the long sheet Lp obtained by the sheet set detector 54A. When the leading end position and the Q mark position of the long sheet Lp is notified, the main controller 50 sets the cut timing for the long sheet Lp and drives the cutter 23, sets the image formation timing for the long sheet Lp and notifies it to the image formation controller 52, and/or the like, based on the leading end position and the Q mark position of the long sheet Lp. The functional configuration of the image formation apparatus 1 is as described above.

[1-3. Printing Operation of Image Formation Apparatus]

Here, an outline of a printing operation of the image formation apparatus 1 is briefly described below. The main controller 50 of the image formation apparatus 1 starts the printing operation under the normal print mode or the Q mark print mode. Upon starting the printing operation, the main controller 50 controls the sheet conveyance controller 54 to convey the long sheet Lp to the first standby position W1 or the second standby position W2 in the sheet feeder 10 so as to make the long sheet Lp standing by at the first standby position W1 or the second standby position W2. At this time, the sheet conveyance controller 54 detects, in the normal print mode, the leading end position of the long sheet Lp by the Q mark detector 54B, and detects, in the Q mark print mode, the leading end position of the long sheet Lp and the Q mark position by the Q mark detector 54B. After that, for example, when the printing preparation in the image formation part 11 is completed, the main controller 50 controls the sheet conveyance controller 54 to start the conveyance of the long sheet Lp to convey the long sheet Lp from the standby position to the image formation part 11. Also, at this time, the main controller 50 controls the cutter 23 to cut the long sheet Lp at a predetermined cutting position.

The image formation controller 52 controls the image formation part 11 to form (that is, print) an image on the front surface of the long sheet Lp that is being conveyed from the sheet feeder 10, and conveys the long sheet Lp to the fixation device 12. The fixation device 12 fixes the toner image transferred on the long sheet Lp being conveyed from the image formation part 11 onto the long sheet Lp, and conveys the long sheet Lp to the sheet discharge part 13. The sheet discharge part 13 discharges the long sheet Lp conveyed from the fixation device 12 through the discharge port 6 to the outside of the housing 2. In this way, the image formation apparatus 1 prints an image on the long sheet Lp and discharges the printed long sheet Lp.

[1-4. Reason for Providing First and Second Standby Positions]

Next, a reason why the first standby position W1 and the second standby position W2 are provided as standby positions for the long sheet Lp is described. First, a relationship between the long sheet Lp and the first and second standby positions W1 and W2 is described with reference to FIGS. 3A, 3B, and 4. As described above, the long sheet Lp1 includes the black marks Bm as the Q marks provided at the regular intervals in the sheet conveyance direction. Here, a length of the black mark Bm in the sheet conveyance direction is referred to as D1, and the interval of the black marks Bm (a distance from the leading end of the black mark Bm to the leading end of the next black mark Bm) is referred to as D2. On the other hand, the long sheet Lp2 includes the inter-label mount portions Mob serving as the Q marks at the regular intervals in the sheet conveyance direction. Here, a length of the inter-label mount portion Mob in the sheet conveyance direction is referred to as D3, and the interval of the inter-label mount portions Mob (a distance from the leading end of the inter-label mount portion Mob to the leading end of the next inter-label mount portion Mob) is referred to as D4. In the following example, to simplify the explanation, D1 is equal to D3 (D1=D3) and D2 is equal to D4 (D2=D4). That is, in the long sheets Lp1 and Lp2, the length of the Q mark is D1 and the interval of the Q marks is D2.

Further, a distance from the detection position W0 of the Q mark detection sensor 22 to the first standby position W1 in the sheet feeder 10 is referred to as Da, and a distance from the first standby position W1 to the second standby position W2 is referred to as Db. Here, the distance Da, which is the distance from the detection position W0 to the first standby position W1, is smaller than the interval D2 of the Q marks of the long sheet Lp, and is sufficiently longer than the length D1 of the Q mark. That is, D1<Da<D2. With this configuration, the number of the Q marks that passes through the detection position W0 by the time when the leading end of the long sheet Lp reaches the first standby position W1 in the sheet feeder 10 is limited to one or less. Further, the distance Db, which is the distance from the first standby position W1 to the second standby position W2, is longer than the length D1 of the Q mark. That is, Db>D1.

Note that a distance from the leading end of the long sheet Lp to a Q mark that is closest to the leading end of the long sheet Lp may change depending on each long sheet Lp, depending on the cut position of the long sheet Lp, or the like, for example. Accordingly, when the long sheet Lp is conveyed to the first standby position W1 and stopped at the first standby position W1, the detection position W0 of the Q mark detection sensor 22 may be located between the leading end and the tail end of the Q mark of the long sheet Lp.

In such a case, if the standby position of the long sheet Lp is only the first standby position W1, the Q mark detection sensor 22 detects the leading end of the Q mark just before the long sheet Lp is stopped at the first standby position W1 and detects the tail end of the Q mark just after resuming to convey the long sheet Lp from the first standby position W1. Here, there is a time lag from a time when an instruction is given to a drive unit to stop the long sheet Lp or to resume to convey the long sheet Lp by the first and second conveyance roller pairs 21 and 24 to an actual time when the long sheet Lp is actually stopped or is actually resumed to be conveyed.

Accordingly, the position of the tail end of the Q mark detected by the Q mark detection sensor 22 deviates from the actual position, so that a distance between the detected leading end and the detected tail end of the Q mark is longer than the actual distance (D1). As a result, there is an error between the position of the Q mark that is calculated by the Q mark detector 54B and the actual position of the Q mark. Note that if the Q mark detection sensor 22 detects the leading end and the tail end of the Q mark in succession before the long sheet Lp is stopped at the first standby position W1 or after the long sheet Lp is resumed to be conveyed, the position of the Q mark calculated by the Q mark detector 54B is accurate because there is no affect by the time lag. That is, in order to accurately obtain the position of the Q mark, the Q mark needs to be out of the detection position W0 of the Q mark detection sensor 22 when the long sheet Lp is stopped at the standby position.

For this reason, as the standby position of the long sheet Lp, the second standby position W2 is provided in addition to the first standby position W1. That is, the sheet conveyance controller 54 operates, when the Q mark detection sensor 22 detects the leading end of the Q mark before the leading end of the long sheet Lp reaches the first standby position W1, to change the standby position from the first standby position W1 to the second standby position W2 to keep conveying the long sheet Lp to the second standby position W2 and then stop the long sheet Lp at the second standby position W2 by the sheet feeder controller 54C.

Since the distance Db from the first standby position W1 to the second standby position W2 is longer than the length D1 of the Q mark, the Q mark is always be located downstream from the detection position W0 in the sheet conveyance direction when the long sheet Lp is stopped at the second standby position W2. Therefore, the Q mark detection sensor 22 detects the tail end of the Q mark at some point while the leading end of the long sheet Lp is conveyed from the first standby position W1 to the second standby position W2. With this configuration, the Q mark detection sensor 22 can detect the leading end and the tail end of the Q mark in succession by the time when the leading end of the long sheet Lp reaches the second standby position W2.

Note that in a case where the distance Db from the first standby position W1 to the second standby position W2 is too long, it may be possible that the next Q mark reaches the detection position W0 before the long sheet Lp reaches the second standby position W2, and the size of the sheet feeder 10 is enlarged. Therefore, as long as the distance Db is longer than the length D1 of the Q mark, it is preferable that the distance Db is as short as possible.

Thus, in the image formation apparatus 1, the first standby position W1 and the second standby position W2 are provided. Accordingly, this prevents a situation where the detection position W0 of the Q mark detection sensor 22 is located between the leading end and the tail end of the Q mark when the long sheet Lp is stopped. Therefore, the position of the Q mark can be detected accurately. The reason why the first standby position W1 and the second standby position W2 are provided is as described above. Note that the image formation apparatus 1 uses the second standby position W2 only under the Q mark print mode (that is, only when the Q mark setting is set to "Q mark detection"), and does not use the second standby position W2 under the normal print mode (that is, when the Q mark setting is set to "No Q mark detection").

By the way, after the long sheet Lp is set to the image formation apparatus 1, the user may change the Q mark setting. For example, when the Q mark setting information received from the external device 100 indicates "No Q mark detection" or an initial value of the Q mark setting for the image formation apparatus 1 is set to "No Q mark detection", the image formation apparatus 1 operates under the normal print mode to convey the long sheet Lp set by the user to the first standby position W1 and stop the leading end of the long sheet Lp at the first standby position W1. Then, it is assumed that the user changes through the external device 100 the Q mark setting to "Q mark detection".

In this case, if tying to detect the Q mark by the Q mark detection sensor 22 before the long sheet Lp2 reaches the second standby position W2 after the long sheet Lp is resumed to be conveyed, the image formation apparatus 1 may sometimes be unable to detect the Q mark accurately. More specifically, in a case where the Q mark on the long sheet Lp has already passed the detection position W0 of the Q mark detection sensor 22 at the time when the long sheet Lp is stopped at the first standby position W1, or in a case where the detection position W0 is located between the leading end and the tail end of the Q mark at the time when the long sheet Lp is stopped at the first standby position W1, the Q mark cannot be detected accurately. If the Q mark cannot be detected accurately in such a way, the image formation apparatus 1 results in an undetected error of the Q mark and cannot properly convey the long sheet Lp. Therefore, in such a case, the main controller 50 displays on the display 4 an indication that the Q mark could not be detected, to prompt the user to reset (reload) the long sheet Lp to the image formation apparatus 1.

In consideration with the above, in the image formation apparatus 1 according to an embodiment, when the print mode is changed from the normal print mode to the Q mark print mode by the Q mark setting being changed from "No Q mark detection" to "Q mark detection" after the long sheet Lp is set by the user, the sheet retraction controller 54D retracts the long sheet Lp that is stopped at the first standby position W1 to a position where the leading end of the long sheet Lp is slightly upstream of the detection position W0 of the Q mark detection sensor 22 in the sheet conveyance direction, and then conveys again the long sheet Lp1 in the sheet conveyance direction. Accordingly, the image formation apparatus 1 can accurately detect the Q mark on the long sheet Lp by the Q mark detection sensor 22 before the long sheet Lp1 reaches the first standby position W1 after the long sheet is conveyed again.

With this operation (hereinafter, may be referred to as sheet standby operation), the image formation apparatus 1 according to an embodiment can accurately detect the Q marks even when the print mode is changed by changing the Q mark setting after the long sheet Lp is set by the user. The sheet standby operation is described in detail below.

[1-5. Sheet Standby Operation in Sheet Feeder]

With reference to a flowchart illustrated in FIG. 6, a procedure of the sheet standby operation when the Q mark setting is changed is described in detail below. Here, a case where a default (initial) Q mark setting is set to "No Q mark detection", and the long sheet Lp that is set to the image formation apparatus 1 is a long sheet Lp1 having black marks Bm is explained as an example. The sheet standby operation is an operation performed mainly by the sheet conveyance controller 54. Note that in the following explanation, along with the procedure of the sheet standby operation, changes in the position of the long sheet Lp1 during the sheet standby operation are explained with reference to a transition diagram illustrated in FIG. 7.

Figure 6:
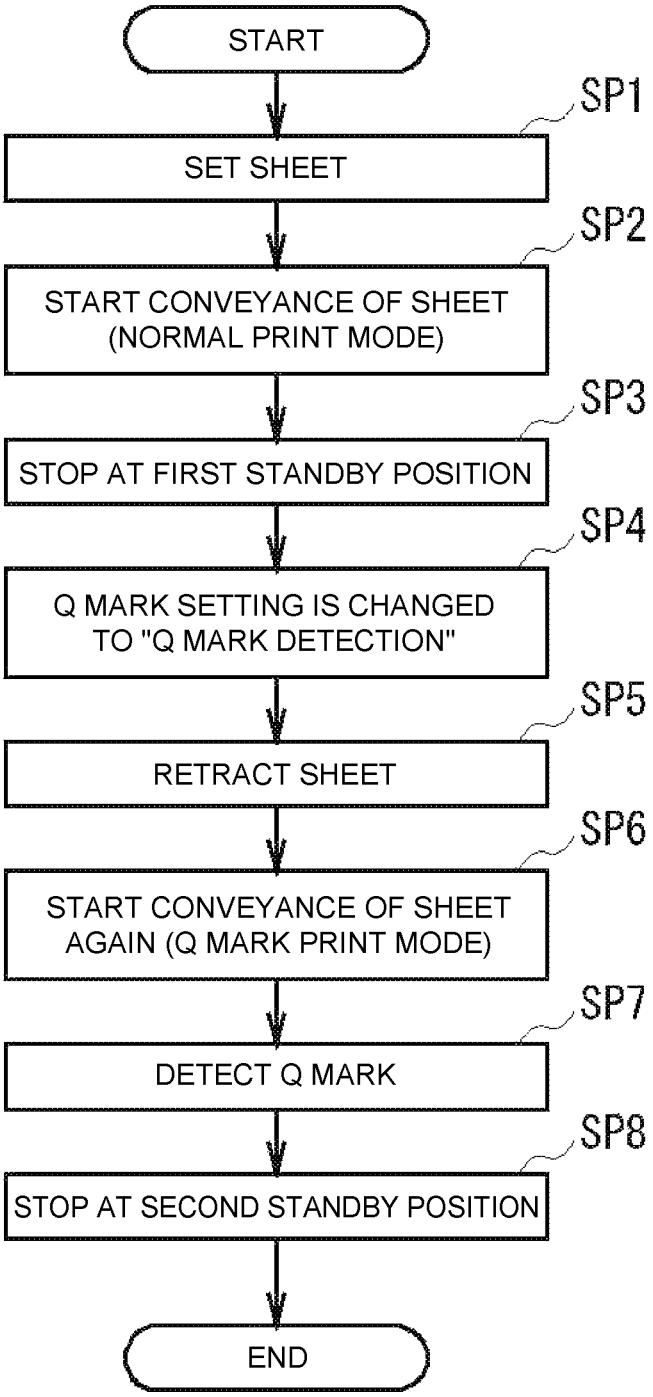
FIG. 6 is a flowchart illustrating a procedure of a sheet standby operation.
Figure 7:
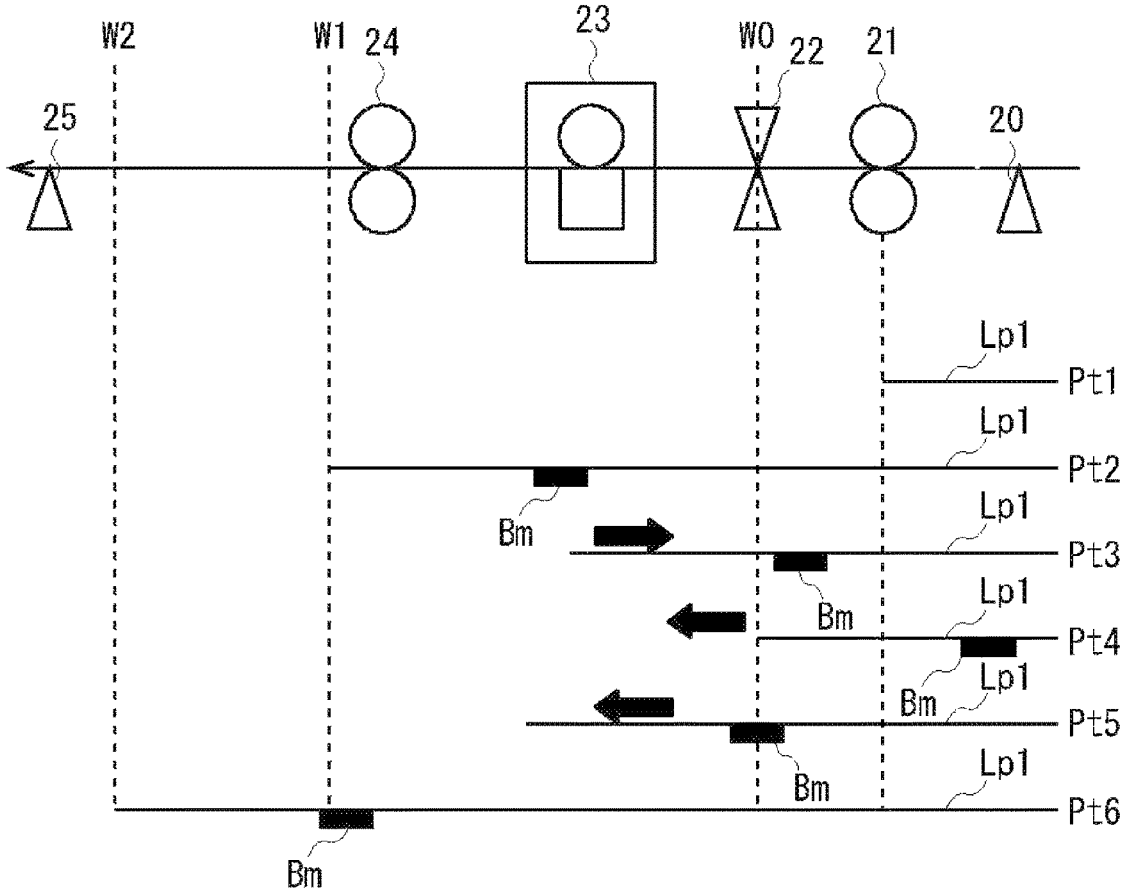
FIG. 7 is a transition diagram illustrating changes in the position of a long sheet during the sheet standby operation according to a first embodiment.

In step SP1 illustrated in FIG. 6, the sheet set detector 54A detects that the long sheet Lp1 is set (loaded) to the image formation apparatus 1. When the sheet set detector 54A detects that the long sheet Lp1 is set to the image formation apparatus 1 in step SP1, the sheet conveyance controller 54 transitions to step SP2. The position of the long sheet Lp1 at this time is illustrated as a pattern Pt1 in FIG. 7. That is, at this time, the leading end of the long sheet Lp1 is located between the sheet set detection sensor 20 and the Q mark detection sensor 22.

In step SP2, since it is notified by the main controller 50 that the Q mark setting is set as "No Q mark detection," the sheet conveyance controller 54 operates under the normal print mode, to instruct the sheet feeder controller 54C to start conveying the long sheet Lp1 under the normal print mode. In response to this instruction, the sheet feeder controller 54C starts conveying the long sheet Lp1.

In subsequent step SP3, with reference to the detected position of the leading end of the long sheet Lp1 obtained by the Q mark detection sensor 22, the sheet feeder controller 54C conveys the long sheet Lp1 up to the first standby position W1 and stops the long sheet Lp1 at the first standby position W1. The position of the long sheet Lp1 that is stopped at the first standby position W1 is illustrated as a pattern Pt2 in FIG. 7. That is, at this time, the leading end of the long sheet Lp1 is located at the first standby position W1.

Here, it is assumed that the Q mark setting is changed from "No Q mark detection" to "Q mark detection" by the external device 100. With this, the main controller 50 receives from the external device 100 the notification, as the print setting information, indicating that the Q mark setting is changed to "Q mark detection", and notifies the sheet conveyance controller 54 that the Q mark setting is changed to "Q mark detection".

In step SP4, the sheet conveyance controller 54 receives from the main controller 50 the notification that the Q mark setting is changed to "Q mark detection". In subsequent step SP5, the sheet conveyance controller 54 instructs, in response to the notification that the Q mark setting is changed to "Q mark detection," the sheet retraction controller 54D to retract (rewind) the long sheet Lp1. In response to this instruction, the sheet retraction controller 54D retracts the long sheet Lp1 until the Q mark detection sensor 22 detects the leading end of the long sheet Lp1, and then stops the long sheet Lp1. The positions of the long sheet Lp1 in this operation are illustrated as patterns Pt3 and Pt4 in FIG. 7. That is, the leading end of the long sheet Lp1 is stopped at the position slightly upstream (right side in FIG. 7) of the detection position W0 of the Q mark detection sensor 22 in the sheet conveyance direction.

In subsequent step SP6, the sheet conveyance controller 54 operates under the Q mark print mode, and instructs the sheet feeder controller 54C to resume the conveyance of the long sheet Lp1. In response to this instruction, the sheet feeder controller 54C resumes the conveyance of the long sheet Lp1.

In subsequent step SP7, when the Q mark detector 54B detects the Q mark (in this example, the black mark Bm) during the conveyance of the long sheet Lp1, the sheet conveyance controller 54 notifies the sheet feeder controller 54C that the Q mark is detected. The position of the long sheet Lp1 at this time is illustrated as a pattern Pt5 in FIG. 7. That is, when the Q mark (the black marks Bm) reaches the detection position W0 of the Q mark detection sensor 22, the leading end of the long sheet Lp1 has not yet reached the first standby position W1.

In subsequent step SP8, since the Q mark is detected before the long sheet Lp1 reaches the first standby position W1, the sheet feeder controller 54C changes the standby position of the long sheet Lp1 form the first standby position W1 to the second standby position W2, and keeps conveying the long sheet Lp1 to the second standby position W2 and stops the long sheet Lp1 at the second standby position W2. The position of the long sheet Lp1 at this time is illustrated as a pattern Pt6 in FIG. 7. That is, the leading end of the long sheet Lp1 is located at the second standby position W2. Note that, in this example, the long sheet Lp1 is stopped at the second standby position W2 in step SP8, however, if the Q mark is not detected before the long sheet Lp1 reaches the first standby position W1, the sheet feeder controller 54C stops the long sheet Lp1 at the first standby position W1. In such a case, the main controller 50 displays on the display 4 an undetected error of the Q mark, for example. The procedure of the sheet standby operation is as described above. Note that sheet standby operation in a case where the long sheet Lp that is set (loaded) to the image formation apparatus 1 is a long sheet Lp2 having the inter-label mount portions Mob is the same as the sheet standby operation illustrated in FIG. 6.

[1-6. Effects]

As described above, in the image formation apparatus 1 according to a first embodiment, after the long sheet Lp is set by the user, the sheet conveyance controller 54 operates under the first print mode since the initial Q mark setting is set to "No Q mark detection" (that is, since the initial Q mark setting is set not to use the Q marks), and thereby causes the sheet feeder controller 54C to convey the long sheet Lp to the first standby position W1 and then stop the long sheet Lp at the first standby position W1. Then, if the Q mark setting is changed from "No Q mark detection" to "Q mark detection" (the Q mark setting is changed to use the Q mark) and thus the print mode is changed from the first print mode to the second print mode, the sheet conveyance controller 54 causes the sheet retraction controller 54D to retract (rewind) the long sheet Lp from the first standby position W1 to the position upstream of the detection position W0 of the Q mark detection sensor 22 in the sheet conveyance direction and then resume to convey the long sheet Lp from the position in the sheet conveyance direction.

With this configuration, the image formation apparatus 1 according to a first embodiment can ensure a sufficient distance (distance Da from the detection position W0 to the first standby position W1) as a conveyance distance of the long sheet Lp for detecting the Q mark, even in a case where the print mode is changed from the first print mode to the second print mode. Accordingly, even when the print mode is changed in response to a change in the Q mark setting after the long sheet Lp is set (loaded) to the image formation apparatus 1, the image formation apparatus 1 can detect the Q mark accurately and thereby can convey the long sheet Lp properly. Therefore, the image formation apparatus 1 according to a first embodiment can perform the conveyance control more reliably than a related art.

Further, since the image formation apparatus 1 according to a first embodiment can detect the Q mark more accurately, the image formation apparatus 1 can prevent a situation where the undetected error of the Q mark occurs and thus can avoid a situation where the user has to reset (reload) the long sheet Lp to the image formation apparatus 1 as much as possible.

2. Second Embodiment

Next, a second embodiment is described. A second embodiment is the same as a first embodiment described above except for a configuration of the sheet conveyance controller 54 and a sheet standby operation by the sheet conveyance controller 54. Therefore, only the configuration of the sheet conveyance controller 54 and the sheet standby operation are described below. Note that in order to distinguish from a first embodiment, the sheet conveyance controller 54 in a second embodiment is hereinafter referred to as a sheet conveyance controller 54*x*.

[2-1. Configuration of Sheet Conveyance Controller]

Figure 8:
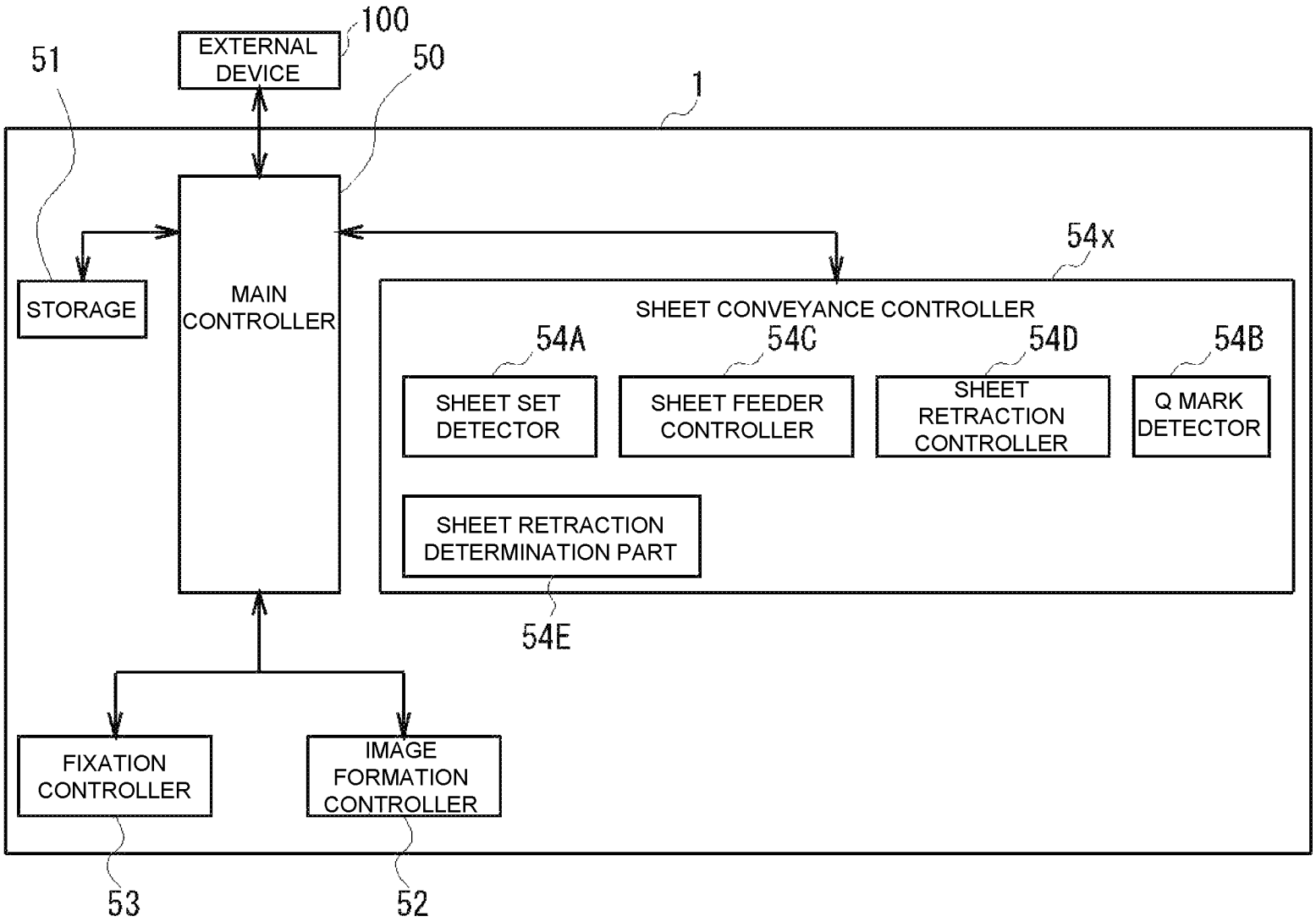
FIG. 8 is a block diagram illustrating a functional configuration of an image formation apparatus according to a second embodiment.

FIG. 8 illustrates a configuration of the sheet conveyance controller 54*x*. Note that the components (the main controller 50, the storage 51, the image formation controller 52, the fixation controller 53) illustrated in FIG. 8 other than the sheet conveyance controller 54*x* have the same functional configurations as in a first embodiment, and thus explanations thereof are emitted for eliminate redundancy.

The sheet conveyance controller 54*x* has a configuration in which a sheet retraction determination part 54E is added to the sheet conveyance controller 54 of a first embodiment. When the Q mark setting is changed after the long sheet Lp is set to the image formation apparatus by the user, the sheet retraction determination part 54E determines whether or not to retract the long sheet Lp based on the Q mark setting before the change and the Q mark setting after the change.

Note that in a first embodiment, when to use the Q marks, the Q mark setting is set as "Q mark detection", whereas when not to use the Q marks, the Q mark setting is set as "No Q mark detection". To the contrary, in a second embodiment, when to use the black marks as the Q marks, the Q mark setting is set as "Black mark", when to use the inter-label mount portions as the Q marks, the Q mark setting is set as "Label", and when not to use the Q marks, the Q mark setting is set as "No Q mark detection". That is, in a second embodiment, the type of the Q marks (black mark, or inter-label mount portion) is set in the Q mark setting when to use the Q marks.

Based on such a Q mark setting, the sheet retraction determination part 54E determines whether or not to retract (rewind) the long sheet Lp. A specific determination method is described later. The configuration of the sheet conveyance controller 54*x* is as described above.

[2-2. Sheet Standby Operation in Sheet Feeder]

Next, a procedure of the sheet standby operation when the Q mark setting is changed is described in detail below with reference to a flowchart illustrated in FIG. 9. In this example, a case where a default (initial) Q mark setting is set as "Black mark", the long sheet Lp that is set to the image formation apparatus 1 is the long sheet Lp1 having the black marks Bm, or the long sheet Lp2 having the black marks Bm and the inter-label mount portions Mob is explained. The sheet standby operation is an operation performed mainly by the sheet conveyance controller 54*x*. Note that in the following explanation, along with the procedure of the sheet standby operation, changes in the position of the long sheet Lp1, Lp2 during the sheet standby operation are explained with reference to transition diagrams illustrated in FIGS. 10A and 10B.

Figure 9:
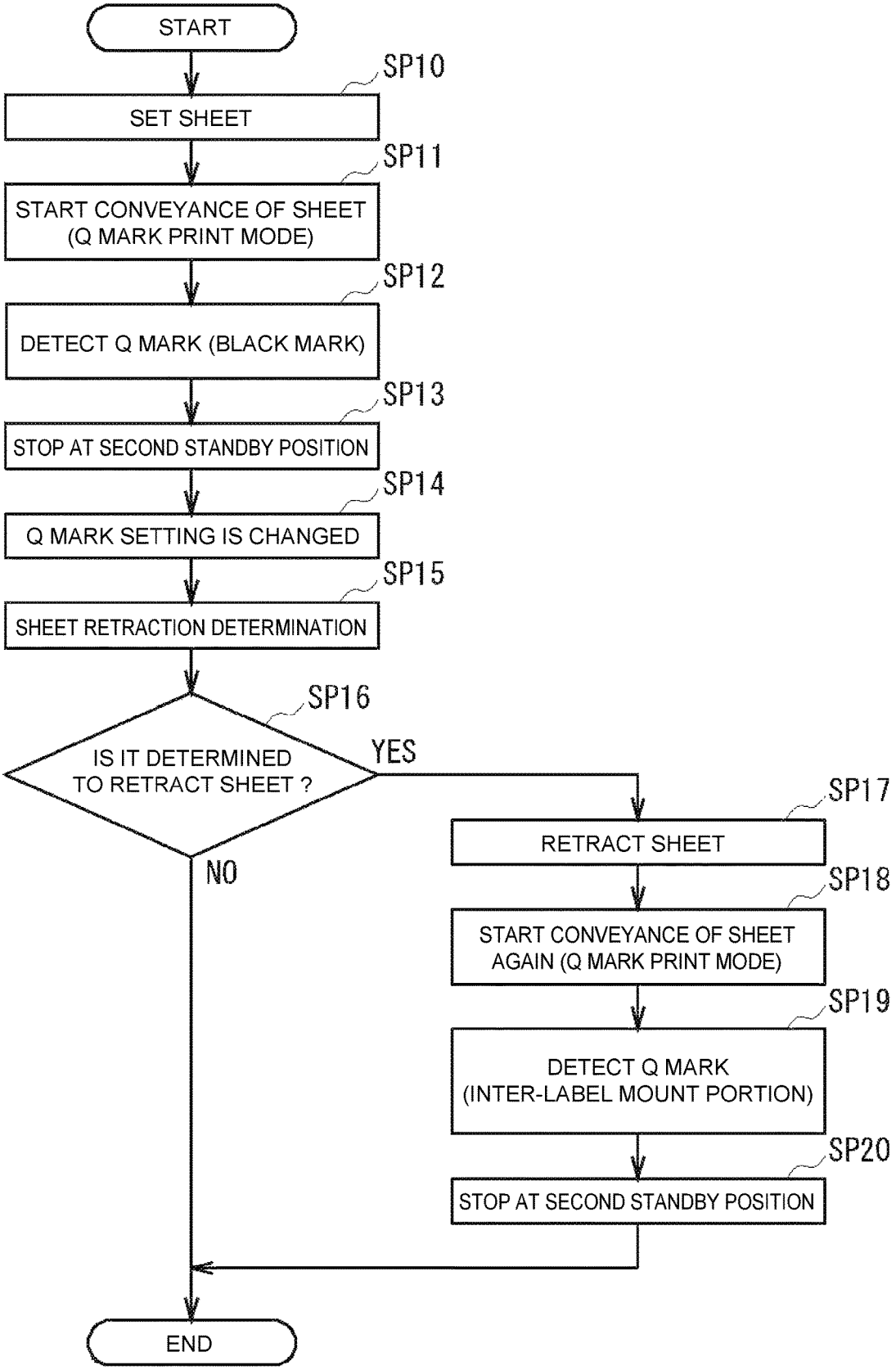
FIG. 9 is a flowchart illustrating a procedure of a sheet standby operation according to a second embodiment.
Figure 10A:
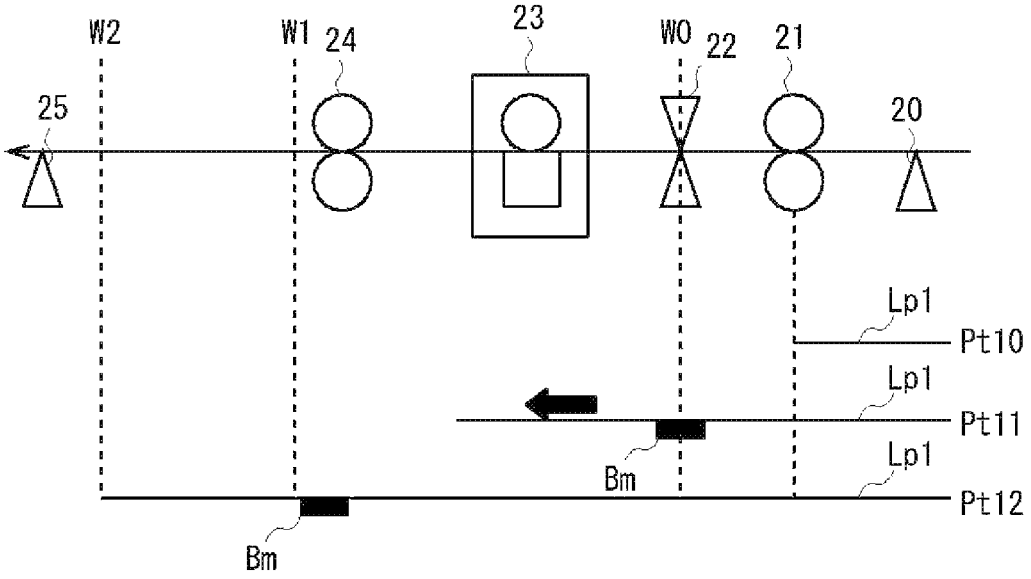
FIGS. 10A and 10B are transition diagrams illustrating changes in the position of a long sheet during the sheet standby operation according to a second embodiment.
Figure 10B:
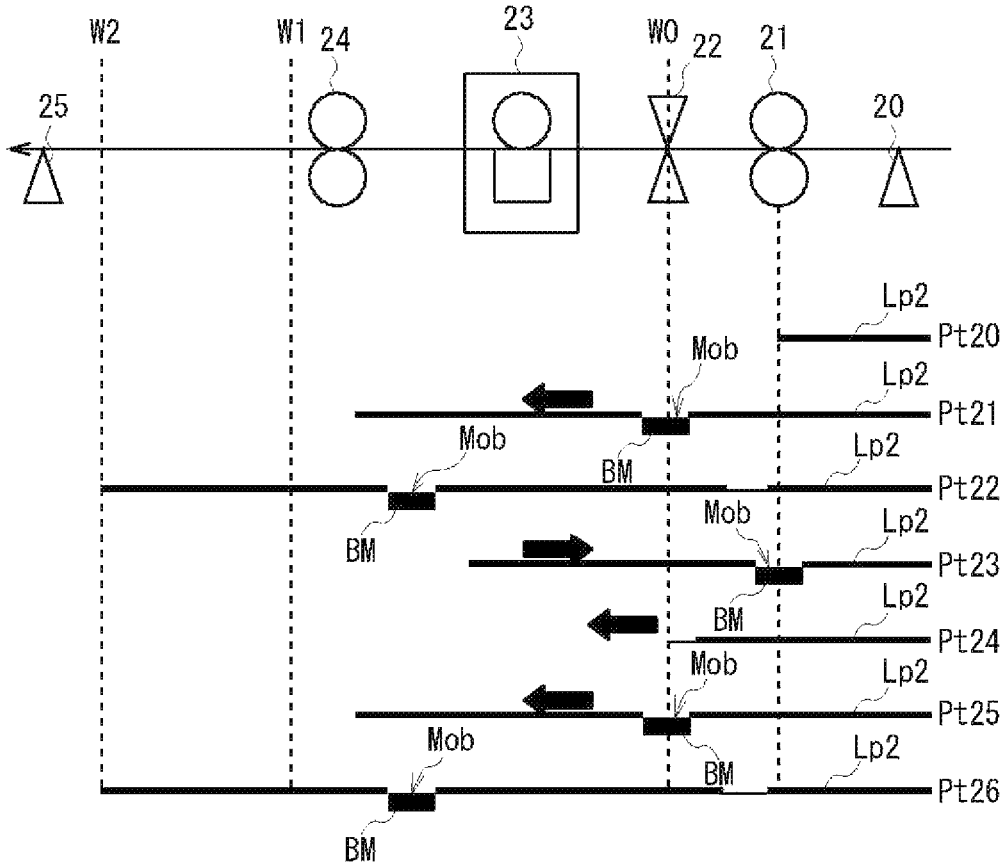

In step SP10 illustrated in FIG. 9, the sheet set detector 54A detects that the long sheet Lp (the long sheet Lp1 or the long sheet Lp2) is set to the image formation apparatus 1. When it is detected that the long sheet Lp is set to the image formation apparatus 1, the sheet conveyance controller 54*x* transitions to step SP11. Note that in a case of the long sheet Lp1, the position of the long sheet Lp at this time is illustrated as a pattern Pt10 in FIG. 10A, whereas in a case of the long sheet Lp2, the position of the long sheet Lp at this time is illustrated as a pattern Pt20 in FIG. 10B. That is, at this time, the leading end of the long sheet Lp is located between the sheet set detection sensor 20 and the Q mark detection sensor 22.

In step SP11, since it is notified by the main controller 50 that the Q mark setting is set as "Black mark", the sheet conveyance controller 54*x* operates under the Q mark print mode, to instruct the sheet feeder controller 54C to start conveying the long sheet Lp under the Q mark print mode. In response to this instruction, the sheet feeder controller 54C starts conveying the long sheet Lp.

In subsequent step SP12, when the Q mark detector 54B detects the black mark Bm during the conveyance of the long sheet Lp, the sheet conveyance controller 54*x* notifies the sheet feeder controller 54C that the black mark Bm is detected. Note that the position of the long sheet Lp when the Q mark is detected at this time is illustrated as a pattern Pt11 in FIG. 10A in the case where the long sheet Lp is the long sheet Lp1, whereas the position of the long sheet Lp when the Q mark is detected at this time is illustrated as a pattern Pt21 in FIG. 10B in the case where the long sheet Lp is the long sheet Lp2. That is, the leading end of the long sheet Lp has not reached the first standby position W1 and the black marks Bm has reached the detection position W0 of the Q mark detection sensor 22.

In subsequent step SP13, since the black mark Bm is detected before the long sheet Lp reaches the first standby position W1, the sheet feeder controller 54C changes the standby position of the long sheet Lp from the first standby position W1 to the second standby position W2, and conveys the long sheet Lp up to the second standby position W2 and stops the long sheet Lp at the second standby position W2. Note that the position of the long sheet Lp stopped at the second standby position W2 is illustrated as a pattern Pt12 in FIG. 10A for the long sheet Lp1 and is illustrated as a pattern Pt22 in FIG. 10B for the long sheet Lp2. That is, at this time, the leading end of the long sheet Lp is located at the second standby position W2. Note that in this example, the long sheet Lp is stopped at the second standby position W2, however, if the black mark Bm is not detected before the long sheet Lp reaches the first standby position W1, the sheet feeder controller 54C stops the long sheet Lp1 at the first standby position W1 and the main controller 50 displays on the display 4 the undetected error of the black mark Bm, for example.

Then, it is assumed that the Q mark setting is changed by the external device 100. At this time, the main controller 50 receives from the external device 100 the notification as the print setting information that the Q mark setting is changed to "No Q mark detection" or to "Label", and thus notifies the sheet conveyance controller 54*x* that the Q mark setting is changed to "No Q mark detection" or to "Label".

In step SP14, the sheet conveyance controller 54*x* receives from the main controller 50 the notification that the Q mark setting is changed to "No Q mark detection" or to "Label". In subsequent step SP15, the sheet conveyance controller 54*x* notifies the sheet retraction determination part 54E that the Q mark setting before the change is "Black mark" and the Q mark setting after the change is "No Q mark detection" or "Label" for causing the sheet retraction determination part 54E to determine whether or not it is necessary to retract the long sheet Lp.

Figures 11, 12:
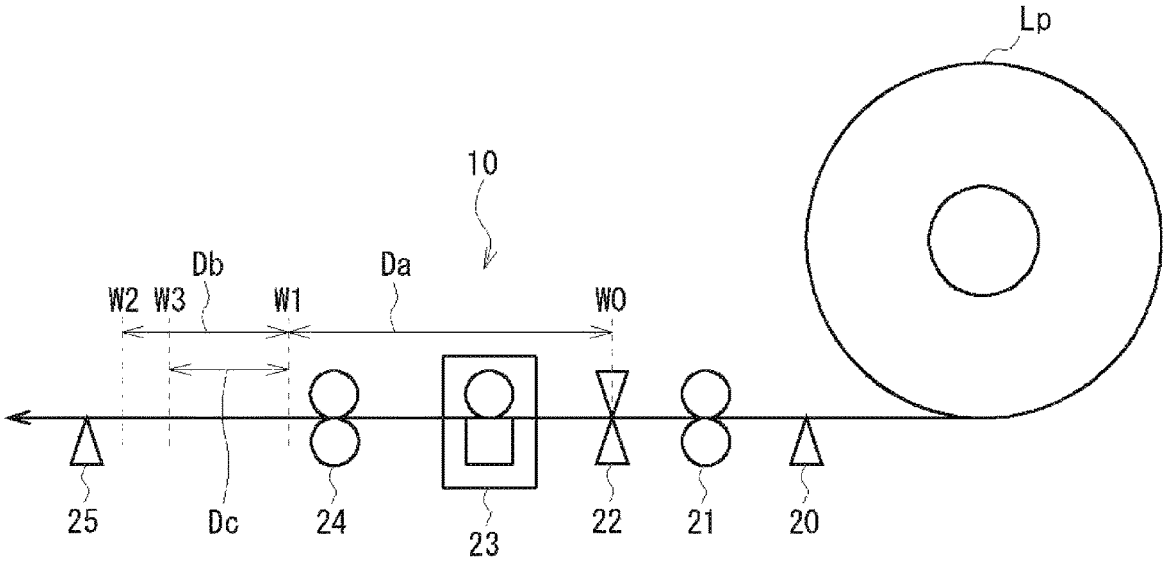
FIG. 11 is a determination table for judging whether or not it is necessary to retract a long sheet according to a second embodiment.
FIG. 12 is diagram illustrating a view of first to third standby positions according to another embodiment.

In subsequent step SP16, based on the table illustrated in FIG. 11, the sheet retraction determination part 54E determines whether or not it is necessary to retract the long sheet Lp. A table illustrated in FIG. 11 indicates whether or not it is necessary to retract the long sheet Lp for each combination pattern between the Q mark setting before the change and the Q mark setting after the change. The circle marks in FIG. 11 indicate that it is necessary to retract the long sheet, and the X marks in FIG. 11 indicate that it is not necessary to retract the long sheet. Note that FIG. 11 indicates whether or not it is necessary to retract the long sheet Lp for each combination pattern, wherein each combination pattern includes a case where the standby position when the Q mark setting is changed is the first standby position W1 and a case where the standby position when the Q mark setting is changed is the second standby position W2. However, in each combination pattern, whether or not it is necessary to retract the long sheet Lp in the case of the first standby position W1 is same as whether or not it is necessary to retract the long sheet Lp in the case of the second standby position W2. Thus, the table may not need to distinguish between the case of the second standby position W1 and the case of the second standby position W2.

The table in FIG. 11 indicates that in the cases where the Q mark setting before the change is set to "Black mark" or "Label" to use the Q mark detection and the Q mark setting after the change is set to "No Q mark detection", it is not necessary to retract the long sheet Lp, and in the other cases, it is necessary to retract the long sheet Lp.

In other words, the table in FIG. 11 indicates that in the cases where the Q mark setting after the change is set to "Black mark" or "Label" to use the Q marks, it is necessary to retract the long sheet Lp since it is necessary to detect the Q marks, whereas in the cases where the Q mark setting after the change is set to "No Q mark detection" not to use the Q marks, it is not necessary to retract the long sheet Lp since it is not necessary to detect the Q marks.

As indicated in FIG. 11, in the case where the Q mark setting before the change is set to "Black mark" and the Q mark setting after the change is set to "Label", that is, in the case where the type of the Q mark to be detected is changed between the Q mark setting before the change and the Q mark setting after the change even though both of the settings are set to use the Q marks, it is necessary to retract the long sheet Lp. This is because, if the type of the Q marks to be used is changed from the black marks Bm to the inter-label mount portions Mob, for example, the inter-label mount portion Mob cannot be accurately detected by the Q mark detection sensor 22 unless the long sheet Lp is retracted.

The sheet retraction determination part 54E has a determination table corresponding to the table illustrated in FIG. 11 stored therein, and, based on the determination table, determines whether or not to retract the long sheet Lp.

For example, it is assumed that the long sheet Lp stopped at the second standby position W2 is the long sheet Lp1 and the Q mark setting is changed from "Black mark" to "No Q mark detection." In this case, the sheet retraction determination part 54E determines that it is not necessary to retract the long sheet Lp1 and thus obtains a negative result (No) in step SP16, and notifies the sheet conveyance controller 54*x* that it is not necessary to retract the long sheet Lp1. When the sheet conveyance controller 54*x* receives the notification that it is not necessary to retract the long sheet Lp1, the sheet conveyance controller 54*x* ends the sheet standby operation with leaving the long sheet Lp1 standing by (in the standby state) at the second standby position W2. After that, the sheet conveyance controller 54*x* operates under the normal print mode which does not user the Q marks.

To the contrary, it is assumed that the long sheet Lp standing by at the second standby position W2 is the long sheet Lp2 and the Q mark setting is changed from "Black mark" to "Label," for example. In this case, the sheet retraction determination part 54E determines that it is necessary to retract the long sheet Lp2 and thus obtains a positive result (Yes) in step SP16, and notifies the sheet conveyance controller 54*x* that it is necessary to retract the long sheet Lp2.

When the sheet conveyance controller 54*x* receives the notification that it is necessary to retract the long sheet Lp2, the sheet conveyance controller 54*x* instructs the sheet retraction controller 54D to retract the long sheet Lp2 in step SP17. In response to this instruction, the sheet retraction controller 54D keeps retracting the long sheet Lp2 until the Q mark detection sensor 22 detects the leading end of the long sheet Lp2 and then stop the retraction. Note that the positions of the long sheet Lp2 at this time are illustrated as patterns Pt23 and Pt24 illustrated in FIG. 10B. That is, the leading end of the long sheet Lp2 when the long sheet Lp2 is stopped in step SP17 is located slightly upstream (the right side in FIG. 10B) of the detection position W0 of the Q mark detection sensor 22 in the sheet conveyance direction.

In subsequent step SP18, the sheet conveyance controller 54*x* instructs the sheet feeder controller 54C to resume the conveyance of the long sheet Lp2 under the Q mark print mode. In response to this instruction, the sheet feeder controller 54C resumes the conveyance of the long sheet Lp2.

In subsequent step SP19, when the Q mark detector 54B detects the inter-label mount portion Mob during the conveyance of the long sheet Lp2, the sheet conveyance controller 54*x* notifies the sheet feeder controller 54C that the inter-label mount portion Mob is detected. Note that the position of the long sheet Lp2 when the inter-label mount portion Mob is detected is illustrated as a pattern Pt25 in FIG. 10B. That is, when the inter-label mount portion Mob is detected, the leading end of the long sheet Lp2 does not reach the first standby position W1 and the inter-label mount portion Mob reaches the detection position W0 of the Q mark detection sensor 22.

In subsequent step SP20, since the inter-label mount portion Mob is detected the before the long sheet Lp2 reaches the first standby position W1, the sheet feeder controller 54C changes the standby position of the long sheet Lp2 from the first standby position W1 to the second standby position W2, and thus conveys the long sheet Lp2 to the second standby position W2 and stops the long sheet Lp2 to stand by at the second standby position W2. Note that, in this example, the long sheet Lp2 is stopped to stand by at the second standby position W2, however, if the inter-label mount portion Mob is not detected before the long sheet Lp2 reaches the first standby position W1, the sheet feeder controller 54C stops the long sheet Lp2 to stand by at the first standby position W1. In such a case, the main controller 50 displays on the display 4 the undetected error of the inter-label mount portion Mob. The procedure of the sheet standby operation is as described above.

[2-3. Effects]

As described above, in the image formation apparatus 1 according to a second embodiment, when the Q mark setting is changed after the long sheet Lp is set by the user, the sheet conveyance controller 54*x* causes the sheet retraction determination part 54E to determine whether or not to retract (pull back, rewind) the long sheet Lp, based on the Q mark setting before the change and the Q mark setting after the change. That is, in the case where the Q mark setting before the change is set to "No Q mark detection" which does not use the Q marks and the Q mark setting after the change is set to "Black mark" or "Label" which uses the Q marks, or in the case where the type of the Q marks to be used is changed between the Q mark setting before the change and the Q mark setting after the change, the sheet retraction determination part 54E determines that it is necessary to retract the long sheet Lp to detect the Q marks based on the Q mark setting after the change. To the contrary, in the case where the Q mark setting before the change is set to "Black mark" or "Label" to use the Q marks and the Q mark setting after the change is set to "No Q mark detection" which does not use the Q marks, the sheet retraction determination part 54E determines that it is not necessary to retract the long sheet Lp since it is not necessary to detect the Q marks after the change of the Q mark setting.

Then, when the sheet retraction determination part 54E determines that it is not necessary to retract the long sheet Lp, the sheet conveyance controller 54*x* keeps the long sheet Lp that has been standing by to stand by and when the sheet retraction determination part 54E determines that it is necessary to retract the long sheet Lp, the sheet retraction controller 54D retracts the long sheet Lp that has been standing by to the position upstream of the detection position W0 of the Q mark detection sensor 22 in the sheet conveyance direction and then resumes to convey the long sheet Lp in the sheet conveyance direction.

With this configuration, when it is not necessary to retract the long sheet Lp once to detect the Q marks, for example, when the Q mark setting after the change is set to "No Q mark detection" (that is, when the print mode is changed from the Q mark print mode to the normal print mode), the image formation apparatus 1 omits the operation of the retraction of the long sheet Lp, so as to quickly perform printing.

Further, the image formation apparatus 1 retracts the long sheet Lp once and then detects the Q marks, not only when the Q mark setting before the change is set to "No Q mark detection" which does not use the Q marks and the Q mark setting after the change is set to "Black mark" or "Label" which uses the Q marks, but also when the type of the Q mark to be used is changed between the Q mark setting before the change and the Q mark setting after the change. With this, even when the setting for the type of the Q mark to be used is changed after the long sheet Lp is set, the image formation apparatus 1 can accurately detect the Q marks and thus can appropriately convey the long sheet Lp. Therefore, the image formation apparatus 1 according to a second embodiment can perform the conveyance control appropriately even when the print mode is changed or the type of the Q marks to be used is changed

3. Other Embodiments

[3-1. Modification 1]

Note that in above-described first and second embodiments, it is assumed that the length D1 of each of the black marks Bm on the long sheet Lp1 is equal to the length D3 of each of the inter-label mount portions Mob on the long sheet Lp2, and the interval D2 of the black marks Bm on the long sheet Lp1 is equal to the interval D4 of the inter-label mount portions Mob on the long sheet Lp2. However, an embodiment is not limited to this. For example, the length D1 of each black mark Bm on the long sheet Lp1 may be different from the length D3 of each inter-label mount portion Mob on the long sheet Lp2.

In such a case, the distance Db from the first standby position W1 to the second standby position W2 is set longer than the larger of D1 and D3, for example. With this configuration, regardless of which of the long sheets Lp1 and Lp2 is set to the image formation apparatus, the Q marks on the long sheet Lp (the long sheet Lp1, Lp2) can be located at a position displaced from the detection position W0 of the Q mark detection sensor 22 when the long sheet Lp is stopped to stand by at the second standby position W2.

Also, not limited to this, a third standby position W3 for the long sheet Lp2 may be provided in addition to the second standby position W2 for the long sheet Lp1 such as being illustrated in FIG. 12, in the case where the length D1 of the black mark Bm on the long sheet Lp1 is different from the length D3 of the inter-label mount portion Mob on the long sheet Lp2. In such a case, the distance from the first standby position W1 to the third standby position W3 is set longer than the length D3.

Further, the interval D2 of the black marks Bm on the long sheet Lp1 may be different from the interval D4 of the inter-label mount portions Mob on the long sheet Lp2. In such a case, the distance Da from the detection position W0 to the first standby position W1 is set shorter than the smaller of D2 and D4. With this configuration, regardless of which of the long sheets Lp1 and Lp2 is set to the image formation apparatus, the number of the Q marks that have passed through the detection position W0 before the leading end of the long sheet Lp (the long sheet Lp1, Lp2) reaches the first standby position W1 can be limited to one or less.

[3-2. Modification 2]

In above-described first and second embodiments, the image formation apparatus 1 is able to handle the long sheet Lp1 having the black marks Bm and the long sheet Lp2 having the inter-label mount portions Mob. However, an embodiment is not limited to this. For example, the image formation apparatus may be configured to handle a long sheet Lp having position detection marks (Q marks) other than the black marks Bm and the inter-label mount portions Mob. Specifically, the image formation apparatus may be configured to handle a long sheet Lp having cutouts as position detection marks at a widthwise end portion of the long sheet Lp, a long sheet Lp having holes as position detection marks at a widthwise end portion of the long sheet Lp, and/or the like, for example.

Even in the number of types of the long sheets to be handled is increased, that is, even in the number of types of the Q marks to be detected is increased, the image formation apparatus can perform the conveyance control appropriately through the sheet standby operation same as or similar to that in above described first or second embodiment.

Further, in above described first and second embodiments, the image formation apparatus 1 handles the roll paper serving as a long sheet. However, an embodiment is not limited to this. For example, the image formation apparatus may be configured to handle other types of the long sheet Lp such as fanfold paper or the like.

[3-3. Modification 3]

Further, in above described first and second embodiments, the first print mode is the normal print mode in which the conveyance control is performed based on the detected position of the leading end of the long sheet Lp, and the second print mode is the Q mark print mode in which the conveyance control is performed based on the detected position of the Q mark (the position detection mark). The image formation apparatus conveys, under the first print mode, the long sheet Lp to the first standby position and stops the long sheet Lp to stand by at the first standby position, and then, if the print mode is switched from the first print mode to the second print mode, retracts the long sheet Lp from the first standby position to the position upstream in the sheet conveyance direction of the detection position W0 once. However, an embodiment is not limited to this.

For example, a first print mode may be one of a print mode to perform the conveyance control based on the position of the leading end of the long sheet Lp and a print mode to perform the conveyance control based on the position of the Q mark, and a second print mode may be the other of the print modes. In such a case, the image formation apparatus may convey, under the first print mode, the long sheet Lp to the first standby position and stop the long sheet Lp to stand by at the first standby position, and then, if the print mode is switched from the first print mode to the second print mode, may retract the long sheet Lp from the first standby position to the position upstream in the sheet conveyance direction of the detection position W0 once. In other words, the image formation apparatus may retract the long sheet Lp from the first standby position W1 to the position upstream in the sheet conveyance direction of the detection position W0, if the print mode is changed to a different print mode in which the long sheet Lp is conveyed to and stopped to stand by at the second standby position W2 when the long sheet Lp is stopped to stand by at the first standby position W1.

[3-4. Modification 4]

Further, in the above description, one or more embodiments are applied to the image formation apparatus 1. However, an embodiment is not limited to this. For example, an embodiment may be applied to an image formation apparatus including an image formation part different from the image formation part 11 of the image formation apparatus 1. For example, an embodiment may be applied to an image formation apparatus that includes an image formation part of an intermediate transfer method in which a toner image formed by an image formation unit is transfer to an intermediate transfer belt, and then the toner image is transferred from the intermediate transfer belt to a long sheet. Further, an embodiment may be applied to an image formation apparatus that includes a monochrome image formation part comprised of a single image forming unit, an image formation apparatus that includes a color image formation part comprised of four or more image formation units, or the like.

Further, in the above description, one or more embodiments are applied to the image formation apparatus 1 which is the electrophotographic printer. However, an embodiment is not limited to this. For example, an embodiment may be applied to any type of an image formation apparatus that handles a long sheet, including an inkjet printer and a thermal transfer printer, a facsimile machine, a multi-function machine, and the like. Further, in above described one or embodiments, the image formation apparatus 1 includes the sheet feeder 10. However, the sheet feeder 10 may be configured to be a unit detachable from the image formation apparatus 1.

[3-5. Modification 5]

Further, in above described embodiments, the image formation apparatus 1 includes, as specific examples of conveyance parts, the first to third conveyance roller pair 21, 24, and 40, and the transfer belt 31. However, an embodiment is not limited to this. For example, the image formation apparatus 1 may include a conveyance part(s) different from the first to third conveyance roller pair 21, 24, and 40, and the transfer belt 31, as long as the conveyance part(s) can convey a medium. Further, in above described embodiments, the image formation apparatus 1 includes, as a specific example of a detector to detect position detection marks, the Q mark detection sensor 22 and the Q mark detector 54B. However, an embodiment is not limited to this. For example, the image formation apparatus 1 may include a detector different from the Q mark detection sensor 22 and the Q mark detector 54B, as long as the detector can detect position detection marks. Further, in above described embodiments, the image formation apparatus 1 includes, as a specific example of a conveyance controller to perform a conveyance control for a medium, the sheet conveyance controller 54 or 54*x*. However, an embodiment is not limited to this. For example, the image formation apparatus 1 may include a conveyance controller different from the sheet conveyance controller 54 or 54*x*, as long as the conveyance controller can perform a conveyance control for a medium. As an example, the sheet set detector 54A, the Q mark detector 54B, the sheet retraction determination part 54E included in the sheet conveyance controller 54*x* in above described second embodiment may be provided separately from the sheet conveyance controller 54*x*.

[3-6. Modification 6]

Further, the invention is not limited to one or more embodiments described above. For example, the invention may extend to its application range to an embodiment in which some or all of the above-described embodiments are arbitrarily combined, and to an embodiment in which a part is extracted.

The invention can be widely used in an image formation apparatus such as printers, facsimile machines, multi-function machines, etc. that handle a long sheet.

The invention includes other embodiments in addition to the above-described embodiments without departing from the spirit of the invention. The embodiments are to be considered in all respects as illustrative, and not restrictive. The scope of the invention is indicated by the appended claims rather than by the foregoing description. Hence, all configurations including the meaning and range within equivalent arrangements of the claims are intended to be embraced in the invention.

The invention claimed is:

1. An image formation apparatus, comprising:

an image formation part that forms an image on a medium;

a conveyance part that conveys the medium;

a detector that detects a leading end of the medium and a position detection mark provided on the medium; and a conveyance controller that perform a conveyance control of the medium by controlling the conveyance part under one of a first print mode and a second print mode, wherein the conveyance control of the medium is performed based on one of the leading end of the medium and the position detection mark under the first print mode, and the conveyance control of the medium is performed based on the other of the leading end of the medium and the position detection mark under the second print mode, wherein the conveyance controller is configured, when switching from the first print mode to the second print mode after conveying the medium to and then stopping at a first standby position downstream in a medium conveyance direction of a detection position of the detector under the first print mode, to retract the medium from the first standby position to a position upstream of the detection position of the detector in the medium conveyance direction and then resume to convey the medium in the medium conveyance direction.

2. The image formation apparatus according to claim 1, wherein the conveyance controller performs the conveyance control for the medium with reference to the leading end of the medium under the first print mode, and the conveyance controller performs the conveyance control for the medium with reference to the position detection mark under the second print mode.

3. The image formation apparatus according to claim 2, wherein the conveyance controller is configured, when a setting is changed from a first setting not to use the position detection mark to a second setting to use the position detection mark, after conveying the medium to the first standby position and then stopping the medium at the first standby position under the first print mode corresponding to the first setting not to use the position detection mark, to switch from the first print mode to the second print mode, retract the medium from the first standby position to the position upstream in the medium conveyance direction of the detection position of the detector and then resume to convey the medium in the medium conveyance direction under the second print mode.

4. The image formation apparatus according to claim 2, wherein the conveyance controller is configured, when the position detection mark is detected by the detector after the medium is retracted from the first standby position to the position upstream of the detection position of the detector and before the medium reaches the first standby position again, to keep conveying the medium in the medium conveyance direction to a second standby position downstream of the first standby position in the medium conveyance direction and then stop the medium at the second standby position.

5. The image formation apparatus according to claim 2, wherein the conveyance controller is configured, when switching from the second print mode to the first print mode after the medium being conveyed under the second print mode is stopped at a second standby position downstream of the first standby position in the medium conveyance direction, to keep the medium stopping at the second standby position without retracting the medium from the second standby position.

6. The image formation apparatus according to claim 5, wherein the conveyance controller is configured, when a setting for a type of the position detection mark to be used is changed after the medium being conveyed under the second print mode is stopped at the second standby position, retract the medium from the second standby position to the position upstream of the detection position of the detector in the medium conveyance direction and then resume to convey the medium.

7. The image formation apparatus according to claim 6, wherein the conveyance controller is configured, when the position detection mark having the type after the setting is changed is detected by the detector after the medium is retracted from the second standby position to the position upstream of the detection position of the detector and before the medium reaches the first standby position again, to keep conveying the medium to the second standby position and then stop the medium at the second standby position.

8. A medium conveyance control method executed by an image formation apparatus, wherein the image formation apparatus comprises: an image formation part that forms an image on a medium; a conveyance part that conveys the medium; a detector that detects a leading end of the medium and a position detection mark provided on the medium; and a conveyance controller that perform a conveyance control of the medium by controlling the conveyance part, the method comprising:

conveying the medium under a first print mode that performs the conveyance control with reference to one of the leading end of the medium and the position detection mark to a first standby position downstream of a detection position of the detector in a medium conveyance direction and then stopping the medium at the first standby position; and when switching from the first print mode to a second print mode that performs the conveyance control with reference to the other of the leading end of the medium and the position detection mark after the medium is stopped at the first standby position, retracting the medium from the first standby position to a position upstream in the medium conveyance direction of the detection position of the detector, and then resuming to convey the medium in the medium conveyance direction under the second print mode.

9. The medium conveyance control method according to claim 8, wherein the first print mode performs the conveyance control for the medium with reference to the leading end of the medium, and the second print mode performs the conveyance control for the medium with reference to the position detection mark.

10. The medium conveyance control method according to claim 9, further comprising stopping the medium at a second standby position downstream of the first standby position in the medium conveyance direction after conveying the medium in the medium conveyance direction to the second standby position under the second print mode, and when switching from the second print mode to the first print mode after stopping the medium at the second standby position, keeping the medium stopping at the second standby position without retracting the medium from the second standby position.

11. An image formation apparatus, comprising:

an image formation part that forms an image on a medium;

a conveyance part including at least one of a roller and a belt to convey the medium;

a detector that detects a leading end of the medium and a position detection mark provided on the medium; and a processor configured with a program to operations comprising: a operation as a conveyance controller that perform a conveyance control of the medium by controlling the conveyance part under one of a first print mode and a second print mode, wherein the conveyance control of the medium is performed based on one of the leading end of the medium and the position detection mark under the first print mode, and the conveyance control of the medium is performed based on the other of the leading end of the medium and the position detection mark under the second print mode, wherein the conveyance controller is configured, when switching from the first print mode to the second print mode after conveying the medium to and then stopping at a first standby position downstream in a medium conveyance direction of a detection position of the detector under the first print mode, to retract the medium from the first standby position to a position upstream of the detection position of the detector in the medium conveyance direction and then resume to convey the medium in the medium conveyance direction.

* * * * *